US007963289B1

(12) United States Patent
King

(10) Patent No.: US 7,963,289 B1
(45) Date of Patent: Jun. 21, 2011

(54) HAIR ACCESSORY TO ACHIEVE A FULLER PONYTAIL

(76) Inventor: Leona King, Aztec, NM (US)

( * ) Notice: Subject to any disclaimer, the term of this patent is extended or adjusted under 35 U.S.C. 154(b) by 489 days.

(21) Appl. No.: 12/120,387

(22) Filed: May 14, 2008

(51) Int. Cl.

| | |
|---|---|
| ***A45D 24/00*** | (2006.01) |
| ***A45D 7/02*** | (2006.01) |
| ***A41F 1/00*** | (2006.01) |
| ***A41F 1/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |

(52) U.S. Cl. ..... 132/200; 132/106; 132/276; 132/55; 24/500; 24/501; 24/507

(58) Field of Classification Search ..... 132/200, 132/212, 273, 275–279, 245, 282, 127–135, 132/107, 54, 55, 144–146, 201, 210, 222, 132/223, 242, 246, 247, 250, 251; D28/32, D28/33, 39–42; 24/500, 501, 507, 17 B
See application file for complete search history.

(56) References Cited

U.S. PATENT DOCUMENTS

| | | | | | |
|---|---|---|---|---|---|
| 712,657 | A | | 11/1902 | Davis | |
| 971,519 | A | | 10/1910 | Brannen | |
| D154,205 | S | * | 6/1949 | Kovacs | D28/23 |
| D180,713 | S | | 7/1957 | Hammond | |
| 3,542,041 | A | * | 11/1970 | Mercorella | 132/275 |
| 3,575,164 | A | * | 4/1971 | Heale | 606/204.35 |
| 3,842,849 | A | | 10/1974 | Goodman | |
| 5,044,385 | A | * | 9/1991 | Rhodes | 132/273 |
| D322,145 | S | * | 12/1991 | Coignard | D28/42 |
| 5,379,782 | A | * | 1/1995 | Tabb | 132/275 |
| 5,456,270 | A | * | 10/1995 | Wong | 132/210 |
| 5,495,861 | A | | 3/1996 | Liberman | |
| 5,535,765 | A | * | 7/1996 | Takashima | 132/273 |
| D377,196 | S | * | 1/1997 | Sheppard, Jr. | D19/65 |
| 5,590,668 | A | * | 1/1997 | Macy | 132/200 |
| 5,706,837 | A | * | 1/1998 | Iwata | 132/200 |
| 5,727,574 | A | * | 3/1998 | Frye | 132/210 |
| 5,769,101 | A | | 6/1998 | Iwata | |
| 5,826,593 | A | * | 10/1998 | Haubrich | 132/128 |
| 5,901,713 | A | | 5/1999 | Mroczek | |
| 5,927,297 | A | | 7/1999 | Cooper | |
| 6,000,408 | A | * | 12/1999 | Maturaporn | 132/273 |
| 6,003,521 | A | * | 12/1999 | Huang | 132/275 |
| 6,047,708 | A | | 4/2000 | Panel et al. | |
| 6,050,272 | A | * | 4/2000 | Droin | 132/273 |
| D428,670 | S | * | 7/2000 | Tsai | D28/40 |

(Continued)

OTHER PUBLICATIONS

Et al., "Puffy Pony", http://tonytail.com/StylingTools.htm The Tonytail Company Aug. 13, 2007 , 1.

*Primary Examiner* — Todd E Manahan
*Assistant Examiner* — Vanitha Elgart
(74) *Attorney, Agent, or Firm* — Janeen Vilven; Samantha A. Updegraff; Peacock Myers, P.C.

(57) ABSTRACT

A hair accessory made to increase the body and fullness of a ponytail or pig tails. The hair accessory includes a hinged pair of first and second portions movable between an open position and a closed position, each portion having a hinged end and an opposite end, inward facing teeth, and at least one fastener for releasably fastening the portions in the closed position.

4 Claims, 6 Drawing Sheets

U.S. PATENT DOCUMENTS

| | | | | |
|---|---|---|---|---|
| 6,142,159 | A * | 11/2000 | Lloyd | 132/278 |
| 6,267,120 | B1 * | 7/2001 | Serignat | 132/273 |
| 6,276,368 | B1 | 8/2001 | Giamalva | |
| 6,276,369 | B1 | 8/2001 | Rogers | |
| 6,295,992 | B1 * | 10/2001 | Sapp | 132/200 |
| 6,311,699 | B1 * | 11/2001 | Horman | 132/278 |
| 6,401,726 | B1 * | 6/2002 | Sonstegard | 132/275 |
| 6,427,701 | B1 * | 8/2002 | Roth | 132/245 |
| 6,439,242 | B1 * | 8/2002 | Head et al. | 132/273 |
| 6,484,728 | B1 * | 11/2002 | Chang | 132/133 |
| D468,190 | S | 1/2003 | Kennedy et al. | |
| 6,513,535 | B1 | 2/2003 | Lane | |
| 6,601,590 | B2 | 8/2003 | Neary | |
| 7,004,179 | B1 | 2/2006 | Lunde | |
| 7,017,589 | B1 | 3/2006 | Minnelli | |
| 7,581,548 | B2 * | 9/2009 | Henricksen et al. | 132/275 |
| 2002/0162564 | A1 * | 11/2002 | Head et al. | 132/276 |
| 2009/0288673 | A1 * | 11/2009 | Park | 132/200 |
| 2010/0078036 | A1 * | 4/2010 | Naji | 132/200 |
| 2010/0180911 | A1 * | 7/2010 | Kraft et al. | 132/276 |

* cited by examiner

HAIR ACCESSORY TO ACHIEVE A FULLER PONYTAIL

BACKGROUND OF THE INVENTION

1. Field of the Invention (Technical Field)

Embodiments of the present invention relate to hair accessories and more specifically to accessories that increase the fullness and volume of a ponytail and pigtails.

2. Description of Related Art

Out of the multitudes of hairstyles that have become popular over time, the "ponytail" has remained one of the most popular in one form or another over the years. Formed by gathering together all of a person's hair and securing the gathered strands with an elastic band, the ponytail is the basis of many different hairstyles. A basic ponytail hairstyle is easy to create and is popular among persons of all ages. Various devices have been proposed which seek to enhance the appearance or wearability of the ponytail for the user. However, many of these devices are complicated or do not achieve the fullness of a ponytail that the present invention achieves.

BRIEF SUMMARY OF THE INVENTION

One embodiment of the present invention comprises an apparatus for adding fullness to a ponytail including a hinged pair of first and second portions movable between an open position and a closed position, each portion having a hinged end and an opposite end, inward facing teeth, and at least one fastener, located at the opposite ends of said portions, for releasably fastening said portions in the closed position. This embodiment can optionally include a center channel located around the circumference of said first and second portions and a hair tie band. The embodiment can further include a groove located around at least a portion of the outside circumference of said first and/or second portions. In one alternative embodiment, the apparatus comprises a second portion that is wider than the first portion. The embodiment can also optionally include a hood, wherein the hood extends out from said first portion.

In alternative embodiments of the present invention the first portion and the second portion are circular when fastened. Or alternatively, the first portion and the second portion are oval when fastened. Or the first portion and second portion are egg-shaped when fastened. Finally, the first portion and said second portion can optionally form a star shape when fastened.

In a further embodiment of the present invention, the apparatus can include a button for securing hair into a bun.

Another embodiment of the present invention is a method of enhancing the fullness of a ponytail. The method comprises positioning a hinged pair of first and second portions movable between an open position and a closed position, each portion having a hinged end and an opposite end and inward facing teeth around a portion of hair, fastening the hinged pair of first and second portions around the portion of hair using a fastener, located at the opposite ends of the portions for releasably fastening the portions in a closed position, gathering the remaining hair around the closed hinged pair of first and second portions, positioning a hair tie band over the closed first and second portions, and inserting the hair tie band over the gathered hair in a center channel on the outside of the first and second portions adding fullness to the ponytail.

In an alternative embodiment, the method additionally includes allowing the outside portion of hair to fall over a hood attached to the first portion. The second portion can optionally be wider than the first portion. The method can further include securing hair into a bun using a button.

In yet another embodiment of the present invention, an apparatus adds volume to a ponytail and includes a first portion openly attachable to a second portion, at least one fastener, a center channel located around the circumference of said first and second portions, and a hair tie band. The apparatus can optionally comprise inward facing teeth and/or a hood wherein the hood extends out from the first portion. The apparatus can also optionally have portions that are interconnected without fasteners. Finally, the apparatus can include a plurality of outside grooves located around at least a portion of the outside circumference of the first and/or second portions.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

As used throughout this specification and claims, ponytail is defined as a hairstyle in which multiple strands of hair on the head is pulled away from the face, gathered and secured at the back of the head with a hair tie, clip or similar device. If the hair is divided so that it hangs in two or more sections, those are pigtails. When used in this specification, ponytail also refers to pigtails.

As used throughout the specification and claims, a bun is a type of hairstyle where the hair is pulled back from the face in a ponytail and wrapped in a circular coil around itself, typically on the back of the head or neck. Buns may be tightly gathered or slightly messier and more informal. As used throughout the specification and claims, "a" means one or more.

Figure 1B:
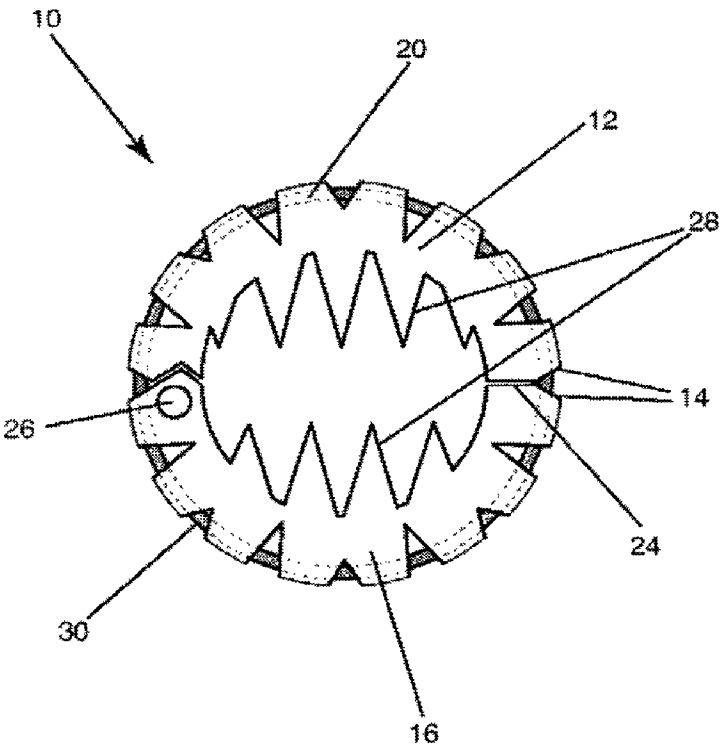
FIGS. 1A-1C are embodiments of the present invention illustrating a two curved portion design with a hinge, outside grooves and inward facing teeth.
Figure 1A:
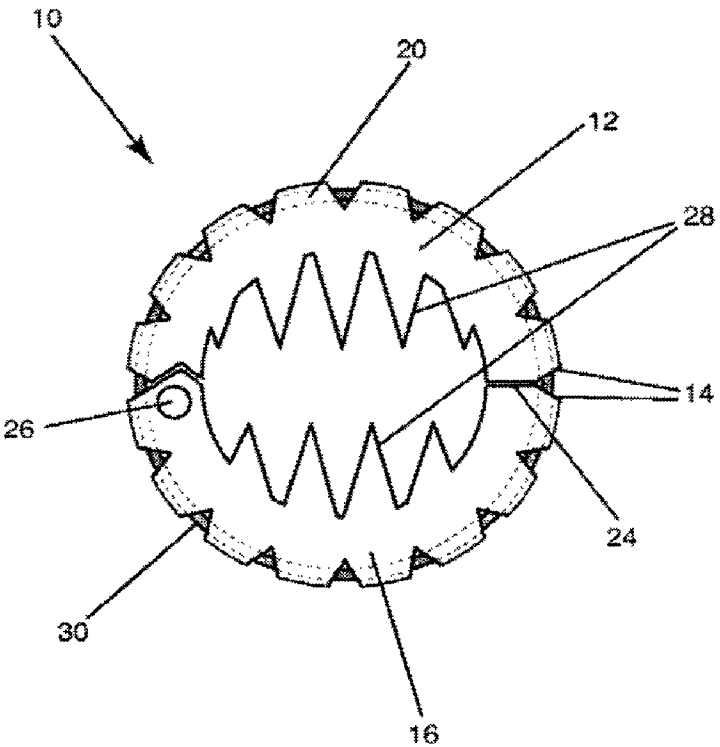
Figure 1C:
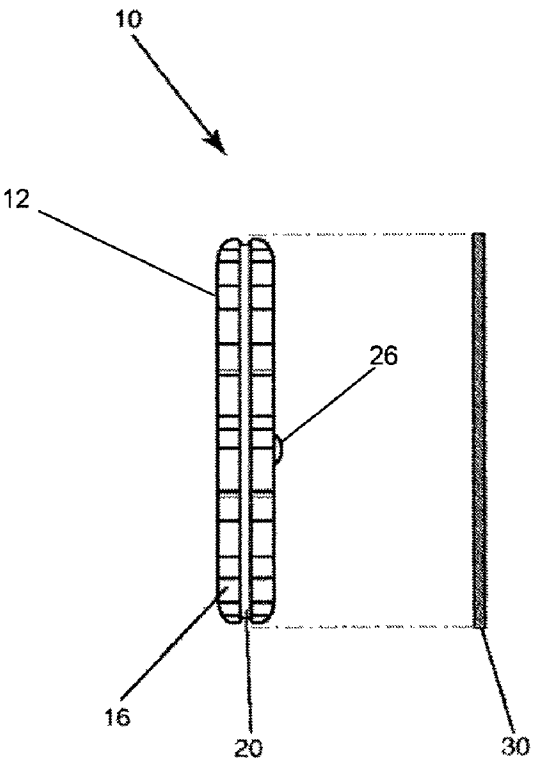

In one embodiment of the present invention, as illustrated in FIG. 1A, hair accessory apparatus 10 comprises first portion 12 and second portion 16 both with outside grooves 14 and outside center channel 20. Hair accessory apparatus 10 further comprises hinge 24, fastener 26 and inward facing teeth 28. A user preferably separates first curved portion 12 from second curved portion 16 at hinge 24 to receive a portion of hair through portions 12 and 16. After a portion of hair is threaded through portions 12 and 16, a user closes hinge 24 bringing portions 12 and 16 together fastening them using fastener 26. Inward facing teeth 28 hold the threaded hair in place. The selected remaining hair is gathered around the outside of hair accessory apparatus 10. Hair tie band 30 is wrapped around the gathered hair and rests into center channel 20. Gathered hair then falls around hair accessory apparatus 10 and into outside grooves 14 increasing the volume and fullness of the hair. FIG. 1C illustrates a side profile of an embodiment of the present invention, where first portion 12 and second portion 16 are equal thicknesses.

Figure 2:
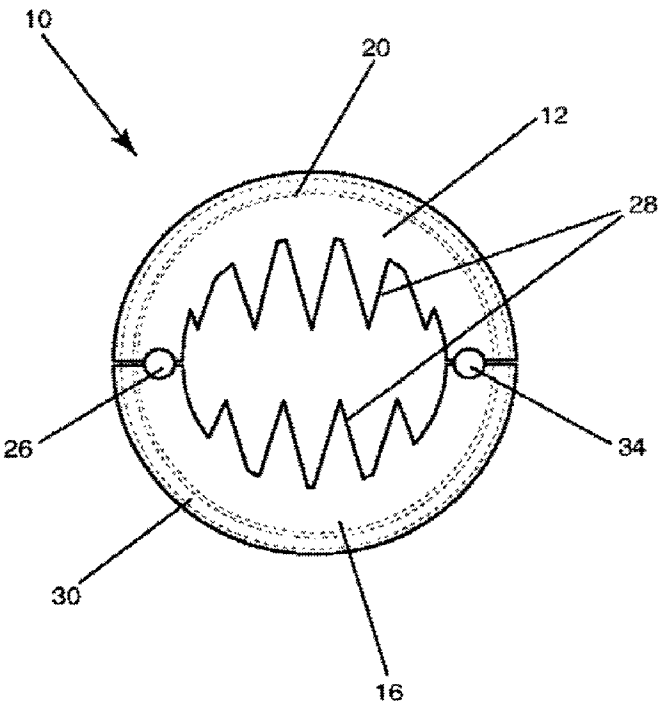
FIG. 2 is another embodiment of the present invention illustrating a two curved portion design as two separate pieces not connected by a hinge.
Figures 5A, 5B, 5C, 5D:
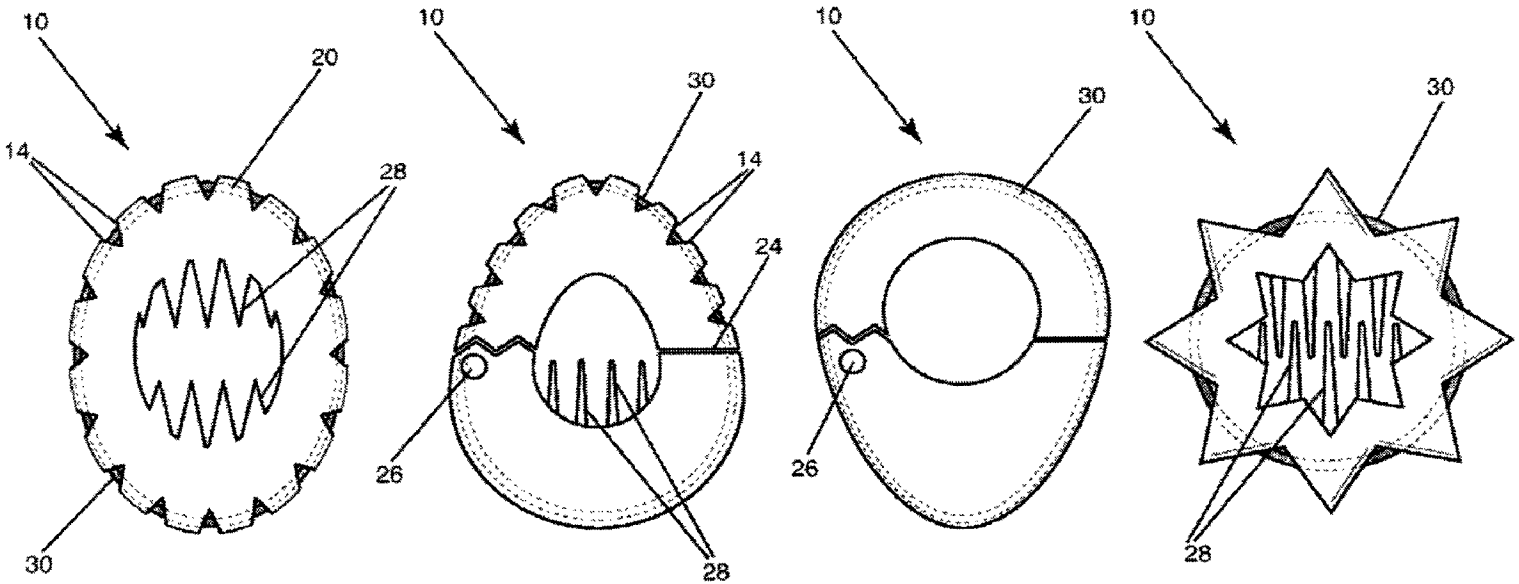
FIGS. 5A-5D illustrate several embodiments of the present invention in varying shapes and sizes.

Outside grooves 14 can optionally vary in width and depth depending on the thickness and amount of a user's hair and ponytail. FIG. 1B illustrates an embodiment comprising varying depths of outside grooves 14. In this embodiment, a user with very thick strands of hair would get the most fullness with wider and deeper outside grooves 14 for the hair to fall into, while a user with very thin strands of hair or with not a lot of hair would get the most fullness and also hide the invention in the user's hair with narrower and shallower grooves. In a non-limiting embodiment, outside grooves 14 are preferably deeper on one side of center channel 20 allowing the gathered hair to go up and over deeper outside grooves 14 adding additional height to the ponytail. Outside grooves 14 can also optionally go partially around first and/or second portions 12 and 16 as illustrated in FIG. 5B or not be included at all, as illustrated in FIGS. 2 and 5C. The distance between inward facing teeth 28 and outside grooves 14 can preferably vary since outside grooves 14 can be shallow and/or deep.

Hair tie band 30 can include, but is not limited to, elastic hair ties, ribbons, leather bands, decorative hair ties and any combination thereof. Decorative hair ties can comprise decorative accessories that can include but are not limited to beads, charms, shells, silver and/or gold dangles, pearls, gems, jewels, ribbons, glitter, sparkles and any combination thereof.

Hair accessory apparatus 10 can optionally vary in width. For example, the width of the outside circumference can be greater than or less than the width of the inside circumference of hair accessory apparatus 10. In other words, hair accessory apparatus 10 can be thick around the outside circumference and become thinner towards the center.

In one embodiment of the present invention, inward facing teeth 28 vary in length to either enlarge or reduce the open space in the center of apparatus 10. For thinner hair strands or when there is not a lot of hair to fasten, longer inward facing teeth 28 is preferable. For thick hair strands or a large volume of hair, shorter inward facing teeth 28 is preferable. Inward facing teeth 28 can optionally reside on only one portion 12 or 16, as illustrated in FIG. 5B, or there can be no inward facing teeth 28, as illustrated in FIG. 5C. Moreover, inward facing teeth 28 can have different shapes, including but not limited to, being pointed at the end, rounded at the end or squared off at the end; inward facing teeth 28 can also optionally intermesh or not.

In another embodiment of the present invention, illustrated in FIG. 2, first curved 12 and second portion 16 are separate pieces, not having hinge 24. In this embodiment, first portion 12 and second portion 16 fasten around a portion of hair with fasteners 26 and 34. Fasteners 26 and 34 can include, but are not limited to, clips, snaps, buttons, and any combination thereof. In a further embodiment, as illustrated in FIGS. 5A and 5D, hair accessory 10 can be made as one piece not including fasteners 26 and 34 or hinge 24.

Figure 3B:
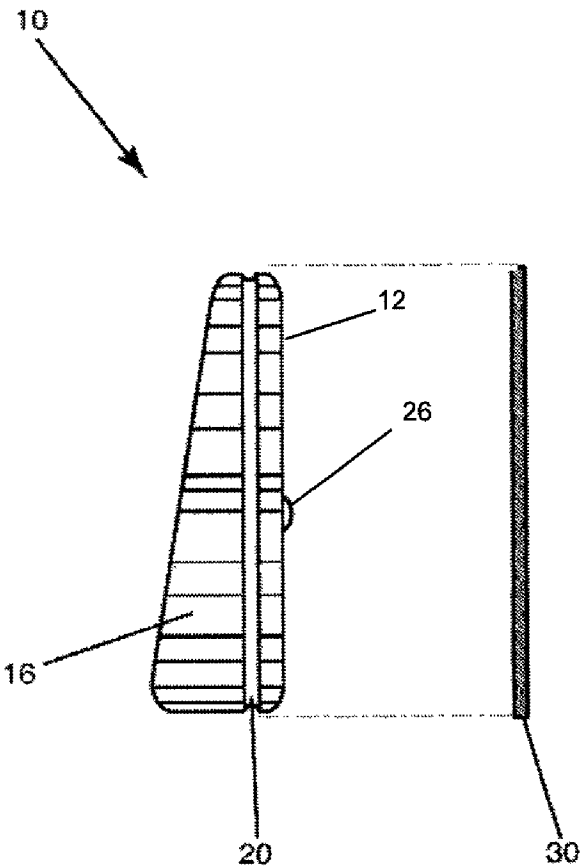
FIGS. 3A-3B illustrate another embodiment of the present invention wherein one of the curved portions is thicker then the other one for added fullness of the ponytail.
Figure 3A:
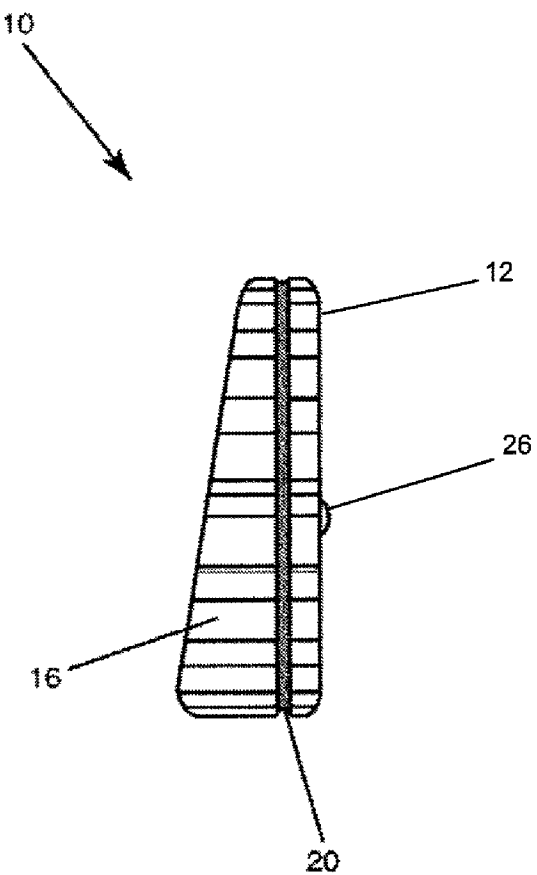

In yet another embodiment of the present invention illustrated in FIGS. 3A and 3B, the bottom portion of second portion 16 is wider than the bottom portion of first portion 12. First portion 12 is placed against a user's head while the wider portion of second portion 16 is directed to the bottom of a user's head where the wider portion is located between the selected portion of hair and elastic band 30. This allows the hair to fall at a greater distance from the head further increasing the look of fullness of the ponytail.

Figure 4B:
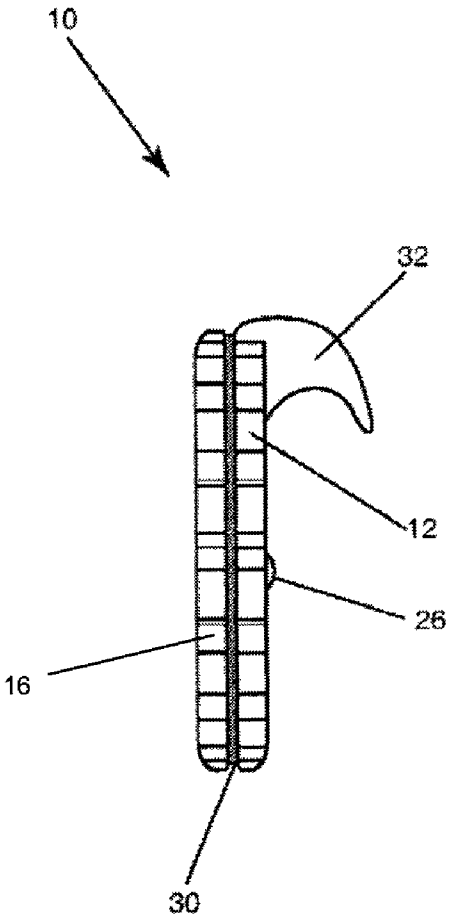
FIGS. 4A-4B illustrate another embodiment of the present invention wherein a hood is attached to one of the curved portions to give the ponytail lift.
Figure 4A:
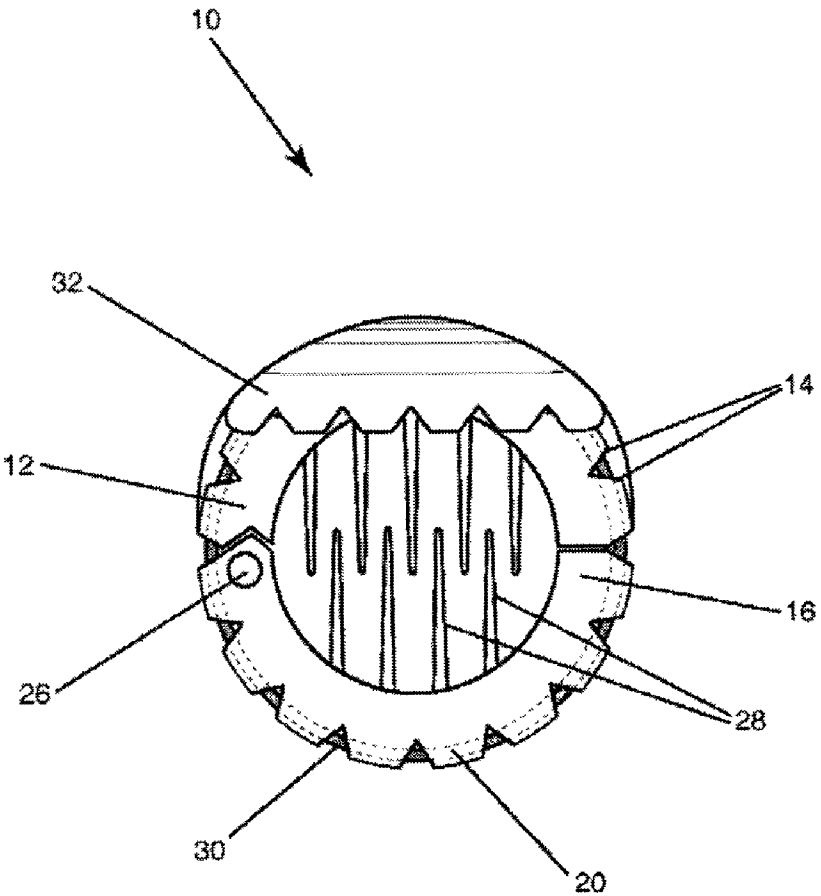

In a further embodiment as shown in FIGS. 4A and 4B, apparatus 10 further comprises hood 32 that attaches to first portion 12 to allow the hair to go up and over hood 32. Hood 32 increases the height of the ponytail and further increases the look of fullness. FIG. 4B in a side perspective of apparatus 10 comprising hood 32.

FIGS. 5A-5D illustrate additional embodiments of the present invention. In FIGS. 5A-5D, apparatus 10 can preferably vary in size and shape including but not limited to circular, oval, elliptical, egg-shaped, star shaped or any combination thereof. Further, FIGS. 5A and 5D illustrate an embodiment of the present invention wherein apparatus 10 is a one-piece apparatus with no portions 12 or 16, and no fasteners 26 or 34 or hinge 24. FIG. 5B illustrates apparatus 10 with inward facing teeth 28 on one only portion 12 or 16 and outside grooves 14 on only one portion 12 or 16. FIG. 5B also comprises hinge 24 and fastener 26. FIG. 5C illustrates apparatus 10 with no outside grooves 14 and no inward facing teeth 28, but does comprise hinge 24 and fastener 26.

In another embodiment, the width of first portion 12 and second curved portion 16 can vary according to the thickness of the user's hair. For example, users with very thick hair may need both first portion 12 and second portion 16 to be wide while users with very thin hair prefer first portion 12 to be narrow in order to ensure apparatus 10 does not poke through the hair and thus become visible, and second portion 16 to be wider in order to increase the fullness of the ponytail.

Figure 6B:
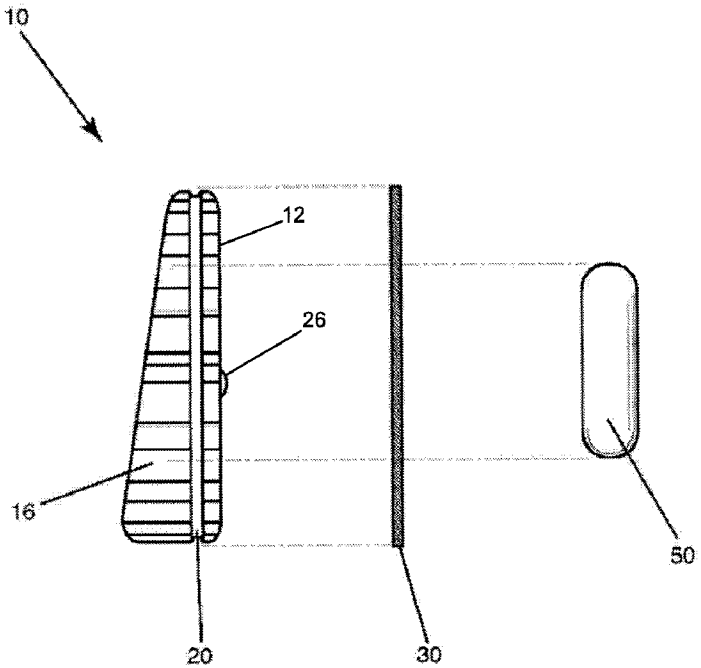
FIGS. 6A-6B illustrate another embodiment of the present invention wherein a button is used to secure the ponytail into a bun.
Figure 6A:
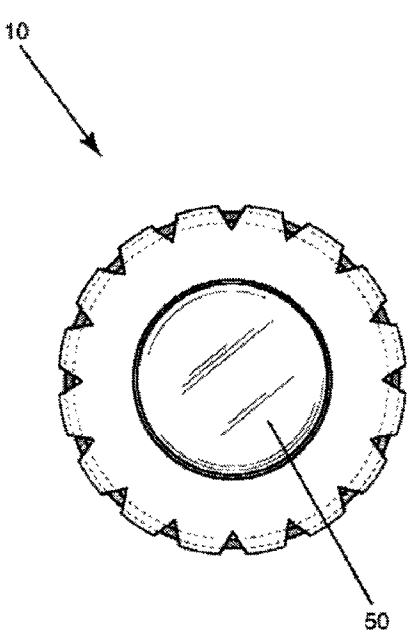

In yet another embodiment and as illustrated in FIGS. 6A and 6B, apparatus 10 additionally comprises button 50. Button 50 is preferably used to secure a user's hair inside apparatus 10 forming a loose bun. In this embodiment, apparatus 10 secures a user's hair into a ponytail, as described in previous embodiments. Then the ends of the hair are gathered and placed inside apparatus 10, and button 50 is then used to secure the hair between the inner circumference of apparatus 10 and the outside of button 50.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of enhancing the fullness of a ponytail, the method comprising:

positioning around a portion of hair a hinged pair of curved first and second portions movable between an open position and a closed position, each portion having a hinged end and an opposite end, inward facing teeth, a plurality of grooves located about an outside circumference of the curved first and second portions, wherein the plurality of grooves extend into but not through the curved first and second portions and wherein the plurality of grooves extend inward toward the inward facing teeth;

fastening the hinged pair of first and second portions around the portion of hair using a fastener, located at the opposite ends of the portions for releasably fastening the portions in a closed position;

gathering the remaining hair over the proximal end of the closed hinged pair of first and second portions to hide the first and second portions;

inserting a hair tie band over the gathered hair in a center channel on the outside of the first and second portions securing the hair over the first and second portions and adding fullness to the ponytail; and allowing the hair to fall over and into the plurality of grooves.

2. The method of claim 1 further comprising allowing the outside portion of hair to fall over a hood attached to the first portion.

3. The method of claim 1 wherein the second portion is wider than the first portion.

4. The method of claim 1 further comprising securing hair into a bun using a button.

* * * * *